US008639151B2

(12) United States Patent
Ohno

(10) Patent No.: US 8,639,151 B2
(45) Date of Patent: Jan. 28, 2014

(54) IMAGE FORMING APPARATUS FOR CONVEYING A HEATED SHEET

(75) Inventor: Masahiro Ohno, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 398 days.

(21) Appl. No.: 13/076,165

(22) Filed: Mar. 30, 2011

(65) Prior Publication Data

US 2011/0262177 A1 Oct. 27, 2011

Related U.S. Application Data

(60) Provisional application No. 61/326,587, filed on Apr. 21, 2010.

(51) Int. Cl.
*G03G 21/20* (2006.01)

(52) U.S. Cl.
USPC ..... 399/94; 399/44; 399/68; 399/361; 399/401; 399/405; 399/406

(58) Field of Classification Search
USPC ..... 399/44, 68, 94, 361, 401, 405, 406
See application file for complete search history.

(56) References Cited

U.S. PATENT DOCUMENTS

| | | | | |
|---|---|---|---|---|
| 6,535,712 | B2 * | 3/2003 | Richards | 399/341 |
| 2008/0199229 | A1 | 8/2008 | Fujita et al. | |
| 2008/0253789 | A1 * | 10/2008 | Yoshinaga et al. | 399/69 |

FOREIGN PATENT DOCUMENTS

| | | |
|---|---|---|
| JP | 2003-223061 | 8/2003 |
| JP | 2006-072182 | 3/2006 |
| JP | 2006-084791 | 3/2006 |
| JP | 2006-251108 | 9/2006 |

OTHER PUBLICATIONS

U.S. Appl. No. 12/952,454 Specification to Ohno (filed Nov. 23, 2010, Published as US20110135333 on Jun. 9, 2011) Originally filed on Mar. 30, 2011 as NPL, date not included.*
U.S. Appl. No. 12/952,454.

* cited by examiner

*Primary Examiner* — Ryan Walsh
(74) *Attorney, Agent, or Firm* — Patterson & Sheridan, L.L.P.

(57) ABSTRACT

According to one embodiment, an image forming apparatus includes a printing unit, a fixing device, a conveying roller, and a control unit. The printing unit is configured to form an image by transferring toner onto a sheet. The fixing device is configured to heat and fix the toner onto the sheet. The fixing device is disposed on the downstream side of the printing unit. The conveying roller is configured to convey the sheet from the fixing device. The conveying roller is disposed on the downstream side of the fixing device. The control unit is configured to control the sheet heated by the fixing device to pass through the conveying roller a plurality of times before the image is formed on the sheet by the printing unit.

20 Claims, 6 Drawing Sheets

IMAGE FORMING APPARATUS FOR CONVEYING A HEATED SHEET

CROSS-REFERENCE TO RELATED APPLICATIONS

This application is based upon and claims the benefit of priority from Provisional Application No. 61/326,587, filed on Apr. 21, 2010; the entire contents of which are incorporated herein by reference.

FIELD

Embodiments described herein relate generally to an image forming apparatus that heats and fixes toner transferred onto a sheet.

BACKGROUND

Typically, in an image forming apparatus, toner is transferred onto a sheet and is then heated and fixed. Conveying rollers convey the sheet on which the toner is heated and fixed to an automatic duplexing device, a paper discharge unit, a finisher device, or the like. The toner on the sheet immediately after being heated and fixed has a high temperature and thus is not immediately cooled. Therefore, the conveying rollers convey the sheet in a high temperature state. In general, the conveying rollers include a plurality of rubber rollers that has a width smaller than that of a sheet on the axis of the conveying rollers in terms of reducing costs.

The low temperature rubber rollers, through contact with the sheet, remove heat from the toner on the sheet while conveying the high temperature sheet. A temperature difference occurs in the toner on the sheet between the portion of the sheet that comes into contact with the rubber rollers and the portion thereof that does not come into contact with the rubber rollers. That is, the cooling of the toner on the sheet becomes different. When the toner on the sheet cools, a gloss difference occurs between the portion of the sheet that comes into contact with the rubber rollers and the portion thereof that does not come into contact with the rubber rollers. As a result, unevenness in gloss occurs on the surface of the sheet. Especially, similarly to a color photograph, when a toner image is transferred over the entire surface of a sheet such as a thick sheet, a coated sheet having glossy coating, or a water-proof sheet, stripe-like unevenness in gloss becomes noticeable on the surface of the sheet.

DETAILED DESCRIPTION

In general, according to one embodiment, an image forming apparatus includes a printing unit, a fixing device, a conveying roller, and a control unit. The printing unit is configured to form an image by transferring toner onto a sheet. The fixing device is configured to heat and fix the toner onto the sheet. The fixing device is disposed on the downstream side of the printing unit. The conveying roller is configured to convey the sheet from the fixing device. The conveying roller is disposed on the downstream side of the fixing device. The control unit is configured to control the sheet heated by the fixing device to pass through the conveying roller a plurality of times before the image is formed on the sheet by the printing unit.

Figure 1:
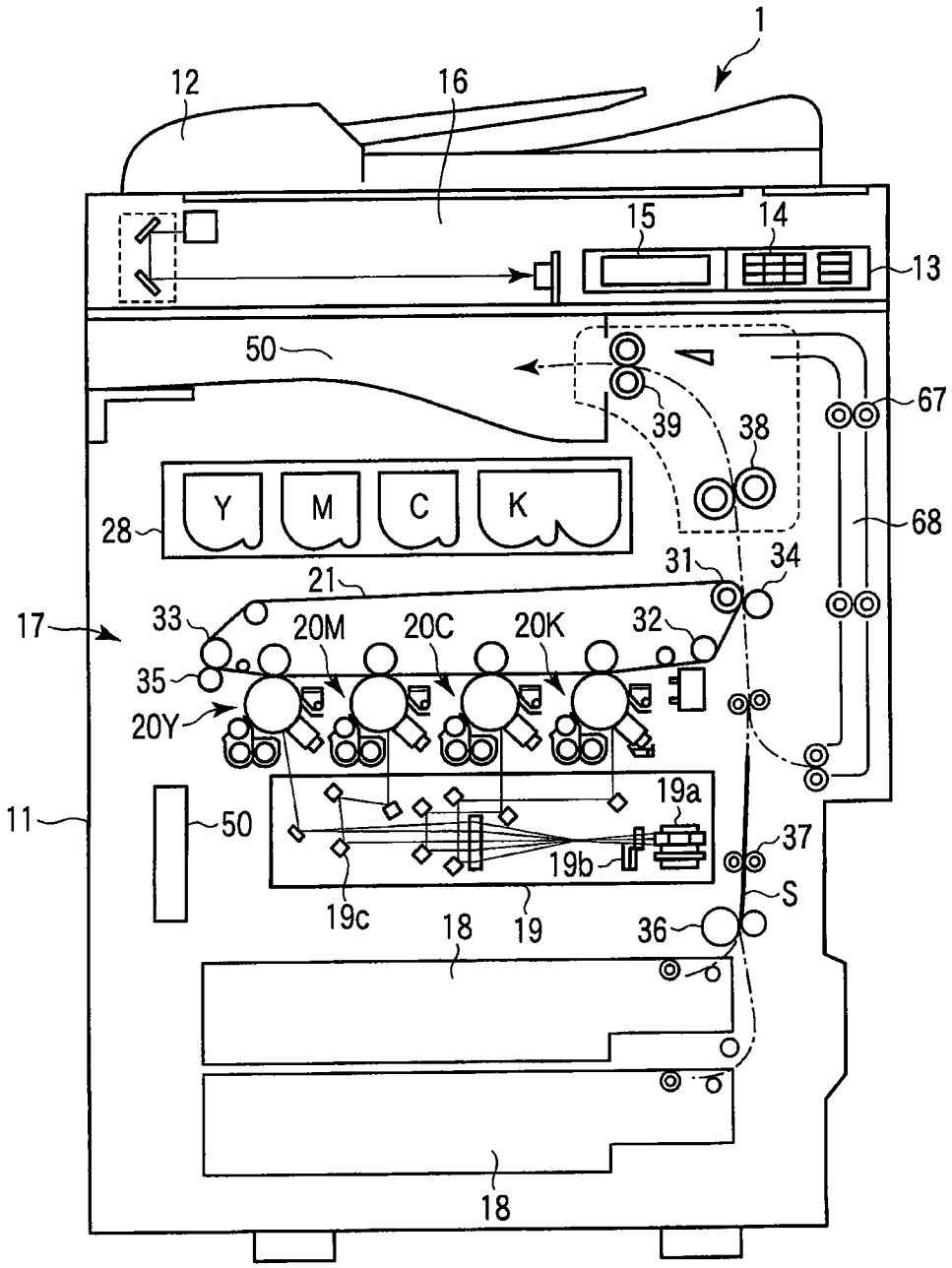
FIG. 1 is an exemplary side view showing the configuration of an image forming apparatus according to a first embodiment.

Hereinafter, the image forming apparatus according to this embodiment will be described in detail with reference to the drawings. In addition, in the drawings, like elements are denoted by like reference numerals. FIG. 1 is a diagram of the configuration of an image forming apparatus according to a first embodiment. The image forming apparatus 1 is, for example, an MFP (Multi-Functional Peripheral), a printer, or a copying machine. In the following description, an MFP is exemplified.

At an upper part of a main body 11 of the image forming apparatus 1, a document table is disposed. On the document table, an automatic document feeder (ADF) 12 is provided to be opened and closed. At the upper part of the main body 11, an operation panel 13 is provided. The operation panel 13 has an operation unit 14 including various keys, and a touch panel-type display unit 15. Under the ADF 12 in the main body 11, a scanner unit 16 is provided. The scanner unit 16 reads an original document sent by the ADF 12 or an original document placed on the document table and generates image data. Moreover, at a center part of the main body 11, a printing unit 17 is provided. At the lower part of the main body 11, a plurality of paper feed cassettes 18 is provided which accommodates a plurality of kinds of paper quality and a plurality of sizes of sheets S.

The printing unit 17 includes photoconductive drums, lasers, and the like. The printing unit 17 processes image data read by the scanner unit 16 or image data generated by a PC (Personal Computer) or the like and forms an image on a sheet S. The printing unit 17 is, for example, a tandem-type color laser printer. The printing unit 17 forms an image by scanning photoconductors with laser beams from a light scanning device (laser unit) 19.

The printing unit 17 includes image forming sections 20Y, 20M, 20C, and 20K for yellow (Y), magenta (M), cyan (C), and black (K), respectively. The image forming sections 20Y, 20M, 20C, and 20K are arranged in parallel in this order from the upstream side to the downstream side on the lower side of an intermediate transfer belt 21.

Figure 2:
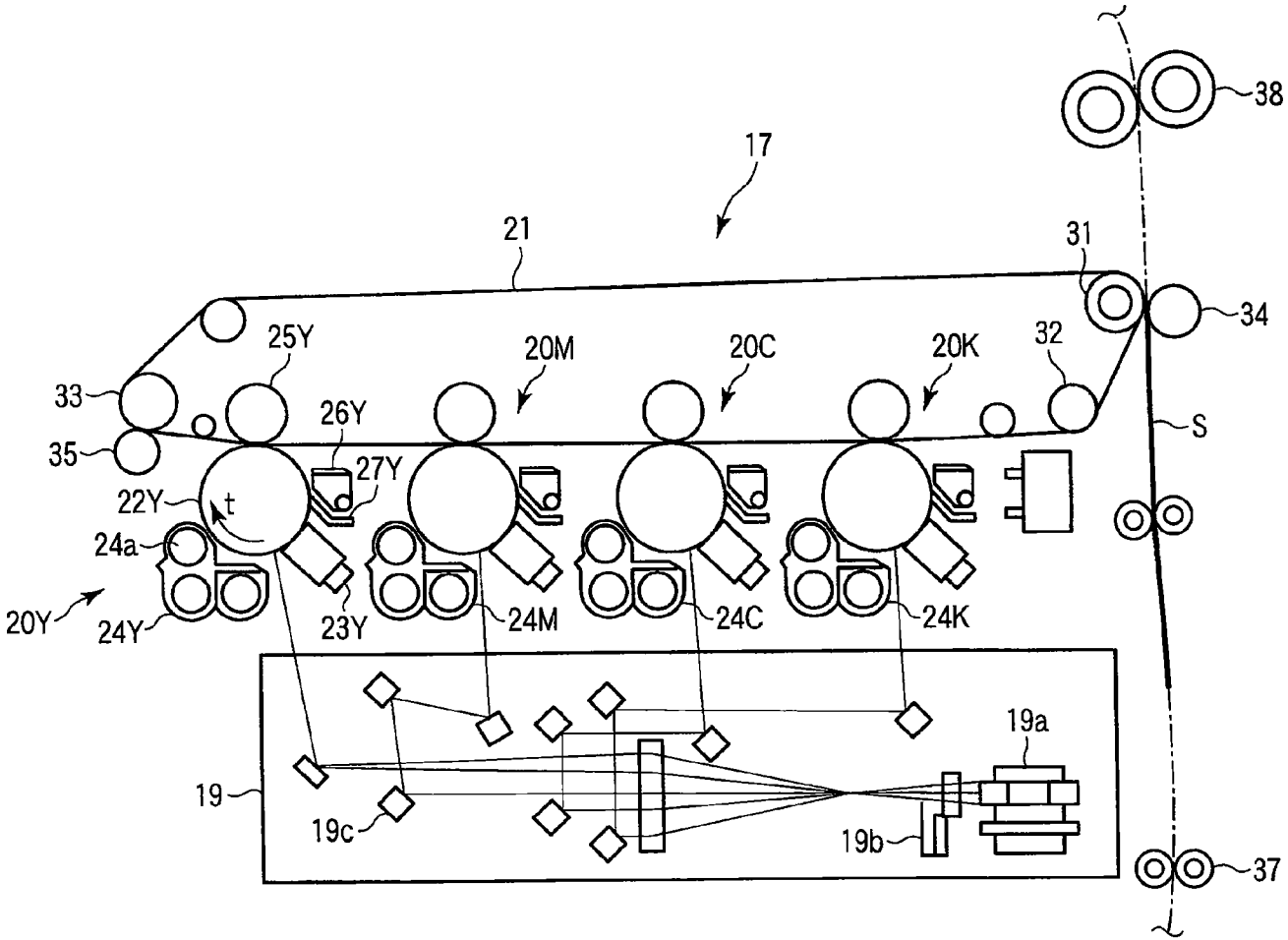
FIG. 2 is an exemplary side view of a printing unit according to the first embodiment.

FIG. 2 is an enlarged view of the printing unit 17 including the image forming sections 20Y, 20M, 20C, and 20K. In addition, in the following description, since the image forming sections 20Y, 20M, 20C, and 20K have the same configuration, the image forming section 20Y will be described as a representative.

The image forming section 20Y has a photoconductive drum 22Y which is an image holding member. In the vicinity of the photoconductive drum 22Y, along a rotation direction t, a charger 23Y, a developing device 24Y, a primary transfer roller 25Y, a cleaner 26Y, a blade 27Y, and the like are disposed. The light scanning device 19 emits a yellow laser beam and forms an electrostatic latent image on the photoconductive drum 22Y. The charger 23Y uniformly charges the entire surface of the photoconductive drum 22Y. The developing device 24Y supplies a two-component developer including yellow toner and a carrier to the photoconductive drum 22Y using a developing roller 24*a* to which a developing bias is applied. The cleaner 26Y removes toner remaining on the surface of the photoconductive drum 22Y using the blade 27Y.

Above the image forming sections 20Y to 20K, a toner cartridge 28 that supplies toner to the developing devices 24Y to 24K is provided. The toner cartridge 28 includes toner cartridges for yellow (Y), magenta (M), cyan (C), and black (K).

The intermediate transfer belt 21 is circularly moved. As the material of the intermediate transfer belt 21, for example, a semiconductive polyimide is used in terms of heat resistance and wear resistance. The intermediate transfer belt 21 is stretched over a driving roller 31 and driven rollers 32 and 33. In addition, the intermediate transfer belt 21 is opposed to and comes into contact with the photoconductive drums 22Y to 22K. At a position where the intermediate transfer belt 21 is opposed to the photoconductive drum 22Y, the primary transfer roller 25Y applies a primary transfer voltage, and the toner image on the photoconductive drum 22Y is primarily transferred onto the intermediate transfer belt 21.

The driving roller 31 over which the intermediate transfer belt 21 is stretched is disposed to oppose a secondary transfer roller 34. When a sheet S passes between the driving roller 31 and the secondary transfer roller 34, the secondary transfer roller 34 applies a secondary transfer voltage to the sheet S. Then the toner image on the intermediate transfer belt 21 is secondarily transferred onto the sheet S. A belt cleaner 35 is provided at the periphery of the driven roller 33 of the intermediate transfer belt 21.

The laser exposure device 19 scans the photoconductive drum 22 with a laser beam emitted from a semiconductor laser element in the axial direction and includes a polygon mirror 19*a*, an imaging lens system 19*b*, a mirror 19*c*, and the like.

Between the paper feed cassette 18 and the secondary transfer roller 34, a separation roller 36, which takes out the sheet S in the paper feed cassette 18, and conveying rollers 37 are provided. Moreover, on the downstream side of the printing unit 17 and the second transfer roller 34, a heating and fixing device 38 is provided. On the downstream side of the heating and fixing device 38, conveying rollers 39 are provided. The conveying rollers 39 discharge the sheet S to a paper discharge unit 50. The paper discharge unit 50 may, using a switchback, convey the sheet S to a reverse conveyance path 68 including conveying rollers 67. The reverse conveyance path 68 is a pathway connecting the downstream of the conveying rollers 39 to the upstream side of the secondary transfer roller 34. In addition, the number of conveying rollers included in the reverse conveyance path 68 is not limited. The reverse conveyance path 68 reverses the sheet S to guide the sheet S toward the secondary transfer roller 34 and may be used for double-sided printing.

Next, operations of the printing unit 17 will be described. The image forming sections 20Y to 20K sequentially form images when image data is input from the scanner unit 16, the PC, or the like. When the image forming section 20Y is exemplified, a laser beam corresponding to the image data for yellow (Y) illuminates the photoconductive drum 22Y and thus an electrostatic latent image is formed. Moreover, the electrostatic latent image of the photoconductive drum 22Y is developed by the developing device 24Y to form a yellow (Y) toner image.

The photoconductive drum 22Y comes into contact with the rotating intermediate transfer belt 21 so as to primarily transfer the yellow (Y) toner image onto the intermediate transfer belt 21 by the primary transfer roller 25Y. After the photoconductive drum 22Y primarily transfers the toner image onto the intermediate transfer belt 21, the residual toner is removed by the cleaner 26Y and the blade 27Y. Thereafter, the photoconductive drum 22Y can perform a subsequent image forming operation.

The image forming sections 20M to 20K form magenta (M), cyan (C), and black (K) toner images in the same process of forming the yellow (Y) toner image. The image forming sections 20M to 20K sequentially transfer the respective toner images onto the same position as that of the yellow (Y) toner image on the intermediate transfer belt 21. Onto the intermediate transfer belt 21, the yellow (Y), magenta (M), cyan (C), and black (K) toner images are transferred to be overlapped, thereby obtaining a full-color toner image.

The intermediate transfer belt 21 secondarily transfers the full-color toner image collectively onto the sheet S through a transfer bias of the secondary transfer roller 34. In synchronization with the full color toner image on the intermediate transfer belt 21 reaching the secondary transfer roller 34, the sheet S is supplied to the secondary transfer roller 34 from the paper feed cassette 18. The heating and fixing device 38 heats the sheet S onto which the toner image is secondarily transferred by the printing unit 17 and the secondary transfer roller 34, thereby fixing the toner image onto the sheet S. The sheet S on which the toner image is fixed is discharged to the paper discharge unit 50 by the conveying rollers 39. In addition, after the secondary transfer is finished, the toner remaining on the intermediate transfer belt 21 is cleaned by the belt cleaner 35.

Figure 3:
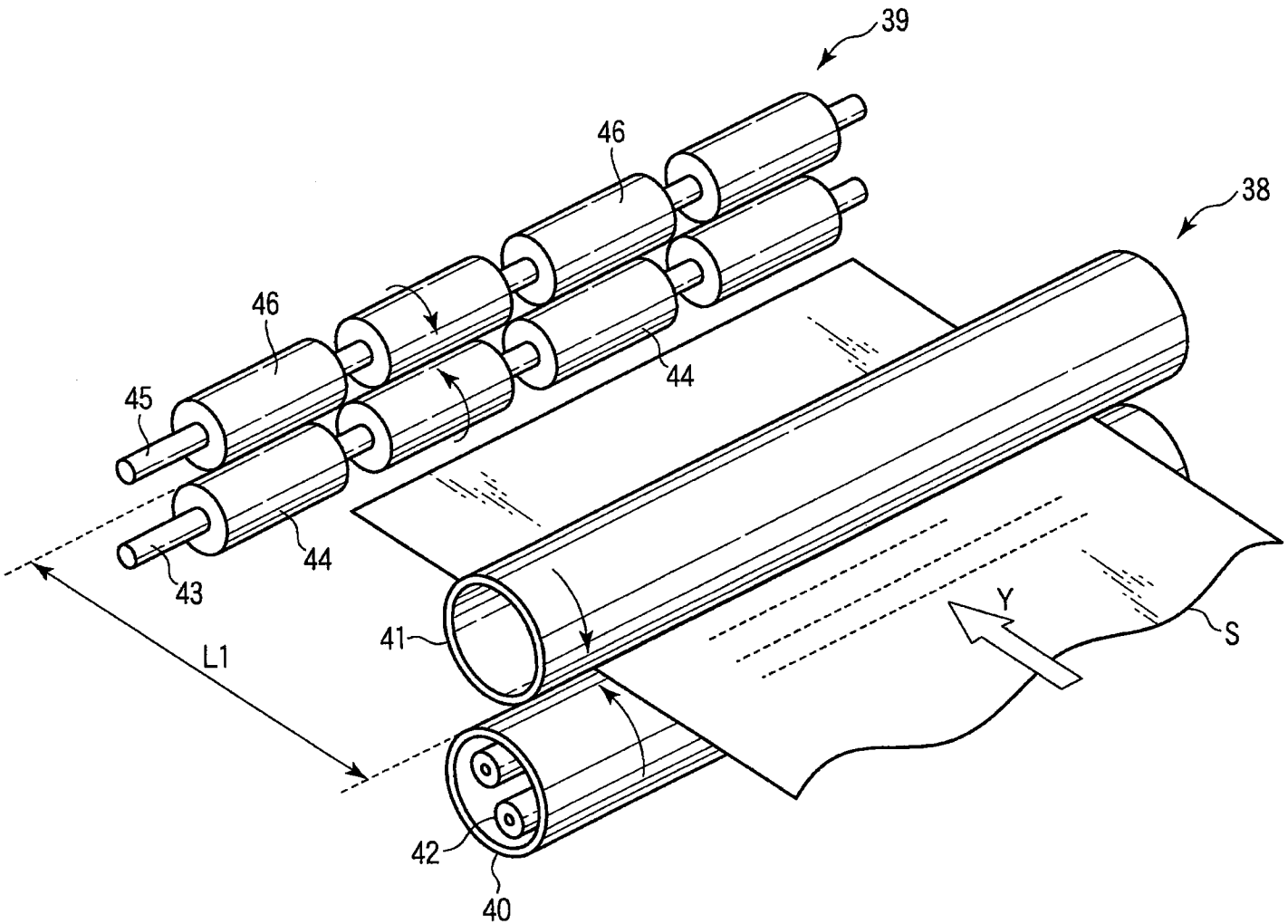
FIG. 3 is an exemplary perspective view showing the configurations of a heating and fixing device and conveying rollers according to the first embodiment.

FIG. 3 is a perspective view showing the configurations of the heating and fixing device 38 and the conveying rollers 39. In addition, the pathway from the heating and fixing device 38 to the conveying rollers 39 is curved as shown in FIG. 1. However, in FIG. 3, for sake of convenience, it is described that the sheet S is conveyed linearly. The heating and fixing device 38 includes a heat roller 40 and a pressurizing roller 41. The heat roller 40 and the pressurizing roller 41 have cylindrical shapes. The heat roller 40 is in contact with the pressurizing roller 40. The heat roller 40 and the pressurizing roller 41 rotate while interposing the sheet S therebetween, thereby conveying the sheet S. The heat roller 40 has a heater 42 therein. The heater 42 uses, for example, IH (Induction Heating) or a halogen lamp. In addition, the heating and fixing device 38 is separated from the conveying rollers 39 by a distance L1. The sheet S on which the toner image is heated and fixed passes through the conveying rollers 39 and is conveyed to the downstream side.

The conveying rollers 39 have a plurality of pairs of opposed rollers. The conveying rollers 39 have a lower roller having a plurality of rubber rollers 44 mounted on a roller shaft 43 perpendicular to the conveyance direction of the sheet S, and an upper roller having a plurality of rubber rollers 46 mounted on a roller shaft 45. In regard to the conveying rollers 39, the lower and upper rollers rotate while interposing the sheet S between the lower and upper rollers thereby conveying the sheet S. The toner on the sheet S immediately after passing through the heating and fixing device 38 is not immediately cooled and is conveyed to the conveying rollers 39 in a high temperature state. In addition, the plurality of rollers of the conveying rollers 39 may be made of sponge, or heat pipes besides rubber.

Figure 4:
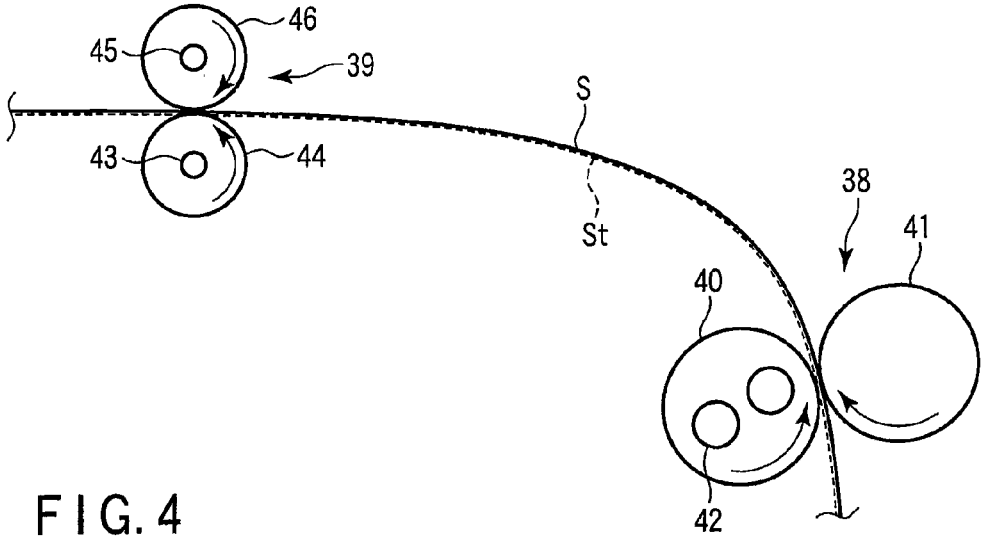
FIG. 4 is an exemplary side view showing the configurations of the heating and fixing device and the conveying rollers according to the first embodiment.

FIG. 4 is a side view showing the configurations of the heating and fixing device 38 and the conveying rollers 39. The conveying rollers 39 are disposed on the downstream side of the heating and fixing device 38. The sheet S is conveyed so that the surface on which toner St is adhered comes into contact with the heat roller 40 of the heating and fixing device 38 and the lower roller (the rubber roller 44) of the conveying rollers 39.

Figure 5:
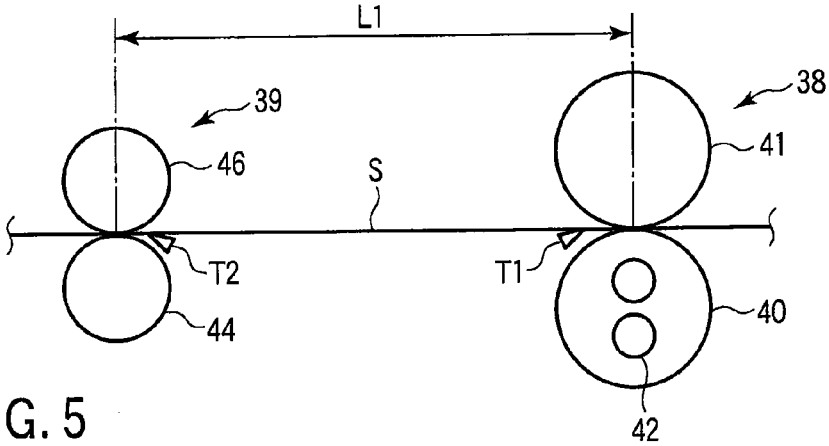
FIG. 5 is an exemplary side view showing the configurations of the heating and fixing device and the conveying rollers according to the first embodiment.

FIG. 5 is a side view showing the configurations of the heating and fixing device 38 and the conveying rollers 39. FIG. 5 shows temperatures of the sheet S when passing through the heating and fixing device 38 and the conveying rollers 39. The temperature of the heater 42 is denoted by TH. The temperature of the sheet S immediately after passing through the heating and fixing device 38 is denoted by T1 (as is the toner St). In addition, the temperature of the sheet S that reaches the conveying rollers 39 is denoted by T2 (as is the toner St). The temperature T2 is slightly lower than the temperature T1 since the temperature of the sheet S is reduced while the sheet S is moved by the distance L1 to reach the conveying rollers 39 from the heating and fixing device 38. That is, the temperature T2 is a temperature obtained by subtracting the amount of decrease in temperature caused while the sheet is moved to the conveying rollers 39 from the heating and fixing device 38, from the temperature T1 of the sheet immediately after passing through the heating and fixing device 38.

Figure 6:
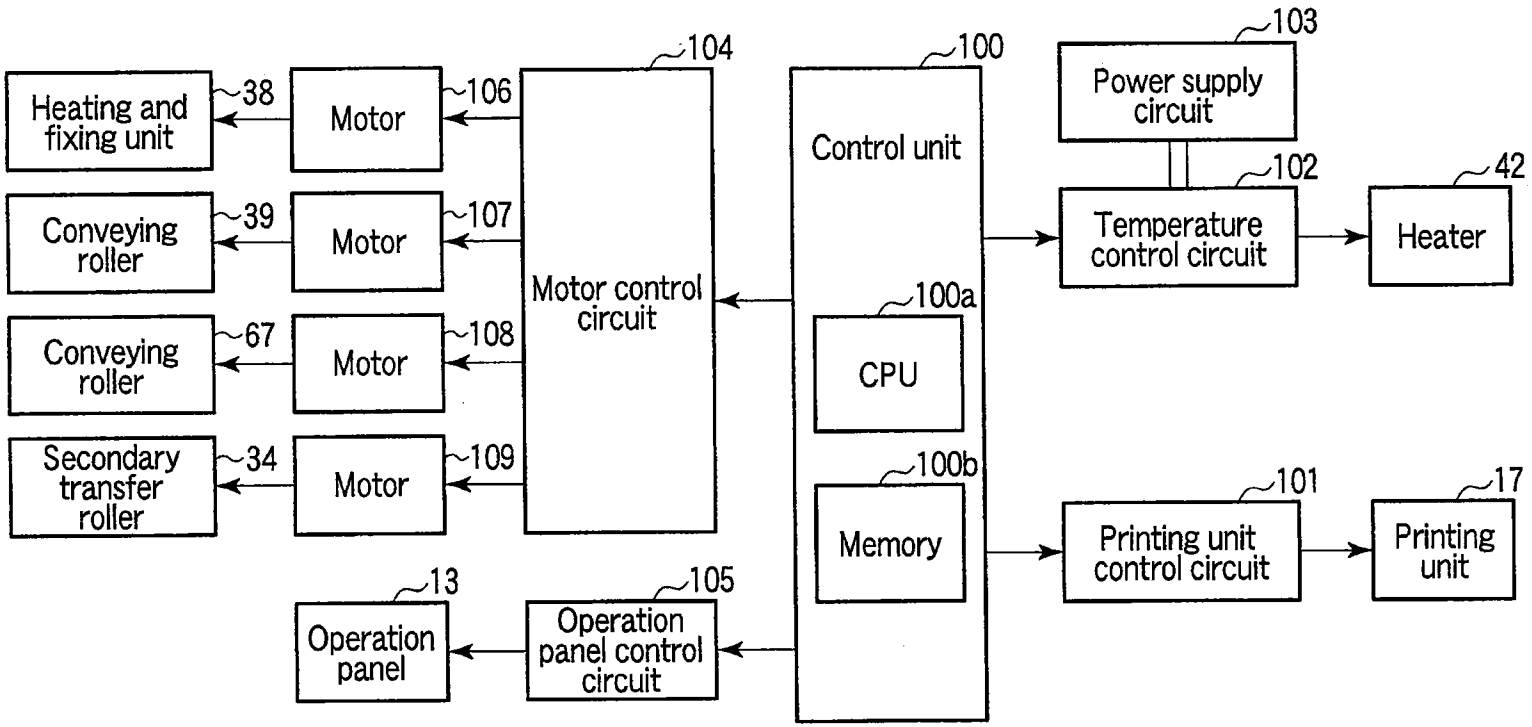
FIG. 6 is an exemplary block diagram showing a control system of the image forming apparatus according to the first embodiment.

FIG. 6 is a block diagram showing a control system of the image forming apparatus 1. The image forming apparatus 1 includes a control unit 100, a printing unit control circuit 101, a temperature control circuit 102, a power supply circuit 103, a motor control circuit 104, and an operation panel control circuit 105. The control unit 100 has a CPU 100*a* and a memory 100*b*. The CPU 100*a* controls each unit of the image forming apparatus 1 on the basis of control programs stored in the memory 100*b*. The memory 100*b* stores various kinds of information in addition to the control programs. The printing unit control circuit 101 controls an image forming operation performed by the printing unit 17 through the command of the control unit 100.

The temperature control circuit 102 controls the temperature of the heater 42 through the control command of the control unit 100. The control unit 100 controls the temperature of the heater 42 so that the temperature of the heater 42 becomes a defined temperature TH. The heater 42 includes a plurality of heaters that heat the center portion and the peripheral portion of the heat roller 40. The temperature control circuit 102 supplies an alternating current voltage (for example, an AC voltage of 100 volts) to the heater 42 from the power supply circuit 103 so as to be heated.

The motor control circuit 104 controls motors 106 to 109 through the command of the control unit 100. The motor 106 rotates and drives the heat roller 40 and the pressurizing roller 41. The motor 107 rotates and drives the conveying rollers 39 to be switched to convey sheets in both directions. The motor 108 rotates and drives the conveying rollers 67. The motor 109 rotates and drives the secondary transfer roller 34. In addition, the motor 109 moves the secondary transfer roller 34 to either of a position to come into contact with the intermediate transfer belt 21 and a position to be separated therefrom. The operation panel control circuit 105 controls the display of the operation panel 13 and a reception of an input through the operation panel 13 through the command of the control unit 100. Using the operation panel 13, a user may input either of printing using a normal mode and printing using a gloss mode. The gloss mode is a mode of performing printing on a thick sheet, a coated sheet, or a water-proof sheet.

In the first embodiment, when the gloss mode is selected through the operation panel 13, before the start of a printing operation (before the printing unit 17 forms an image on the sheet S), the control unit 100 controls the sheet S on which the toner image is not secondarily transferred, and which is heated by the heating and fixing device 38, to pass through the conveying rollers 39 a plurality of times. Here, an operation causing the sheet S on which the toner image is not secondarily transferred and which is heated by the heating and fixing device 38 to pass through the conveying rollers 39 is referred to as a circulation operation of the sheet S. Hereinafter, the circulation operation of the sheet S will be described in detail. When the gloss mode is selected through the operation panel 13, the control unit 100 controls the separation roller 36 to take out the sheet S from the paper feed cassette 18. The control unit 100 controls the conveying rollers 37 to convey the sheet S taken out by the separation roller 36 to the heating and fixing device 38. Here, the printing unit 17 does not transfer the toner image onto the sheet S passing between the driving roller 31 and the secondary transfer roller 34.

The control unit 100 controls the heating and fixing device 38 to convey the sheet S to the conveying rollers 39. In addition, the heater 42 is already heated to the defined temperature TH. Therefore, the sheet S immediately after passing through the heating and fixing device 38 is heated to the temperature T1. Thereafter, the control unit 100 controls the conveying rollers 39 to convey the sheet S until the rear end portion of the sheet S passes through the conveying rollers 39. The rubber roller 44 of the conveying rollers 39 takes away heat from the sheet S having the temperature of T2 when the sheet S heated by the heating and fixing device 38 passes therethrough. This is because the rubber roller 44 does not have a heating mechanism and thus has a temperature that is lower than the temperature T2 and is substantially the same as the temperature of external air before the sheet S passes through.

Subsequently, the control unit 100 controls the conveying rollers 39 to switch back the conveyance direction of the sheet S. The control unit 100 controls the conveying rollers 39 to convey the sheet S to the reverse conveyance path 68. The control unit 100 controls the conveying rollers 67 to circulate the sheet S to the upstream side of the heating and fixing device 38. Here, the printing unit 17 does not transfer a toner image onto the sheet S passing between the driving roller 31 and the secondary transfer roller 34.

The sheet S immediately after passing through the heating and fixing device 38 is again heated to the temperature T1. The control unit 100 controls the heating and fixing device 38 to convey the sheet S to the conveying rollers 39. The rubber roller 44 of the conveying rollers 39 takes away heat from the sheet S having the temperature T2 and thus the temperature thereof is increased, when the sheet S heated by the heating and fixing device 38 passes therethrough. The control unit 100 repeats the circulation operation of the sheet S. The temperature of the rubber roller 44 is increased until it becomes close to the temperature T2 of the sheet S reaching the conveying rollers 39 through a plurality of circulation operations of the sheet S.

The number of passes of the sheet S heated by the heating and fixing device 38 through the conveying rollers 39 due to the circulation operation of the sheet S (hereinafter, referred to as the number of circulations) is not limited. For example, the memory 100*b* stores information regarding the number of circulations defined experimentally in advance. The control unit 100 controls the circulation operation of the sheet S on the basis of the information regarding the number of circulations stored in the memory 100*b*.

The control unit 100 controls the sheet S heated by the heating and fixing device 38 to pass through the conveying rollers 39 a plurality of times and controls the sheet S to be discharged to the paper discharge unit 50 from the conveying rollers 39. Thereafter, the control unit 100 starts a printing operation. That is, the control unit 100 takes out a new sheet S corresponding to the gloss mode using the separation roller 36 and controls the conveying rollers 37 to convey the sheet S to the secondary transfer roller 34. The control unit 100 controls the printing unit 17 to transfer a toner image onto the sheet S passing between the driving roller 31 and the secondary transfer roller 34. The control unit 100 controls the sheet S onto which the toner image is secondarily transferred to be discharged to the paper discharge unit 50 using the heating and fixing device 38 and the conveying rollers 39.

According to the first embodiment, before the sheet S onto which the toner image is secondarily transferred passes through the conveying rollers 39, the surface temperature of the rubber roller 44 of the conveying rollers 39 is increased to be close to the temperature T2 by the plurality of circulation operations of the sheet S. Therefore, when the sheet S onto which the toner image is secondarily transferred and which is heated by the heating and fixing device 38 passes through the conveying rollers 39, the rubber roller 44 does not take away any heat from the toner St even though the rubber roller 44 comes into contact with the toner St on the sheet S. Unevenness in the overall temperature of the toner St on the sheet S does not occur. When the toner St on the sheet S is cooled, the gloss of the toner St on the printed sheet S becomes substantially even over the entire surface. That is, in regard to the sheet S onto which the toner image is secondarily transferred, strip-like unevenness in gloss caused by the contact with the rubber roller 44 is suppressed. Therefore, when a color photograph is printed using a glossy sheet or the like, the user may obtain a satisfactory printing result.

In addition, the user may change the number of circulations stored in the memory 100*b* using the operation panel 13 depending on the degree of satisfaction with the printing result. In addition, when a continuous printing operation of a plurality of copies is input through the operation panel 13, the control unit 100 may control the printing operation to be suspended at an arbitrary timing and the circulation operation of the sheet S to be performed. In this case, it is possible to prevent the temperature of the conveying rollers 39 from decreasing during the continuous printing operation of the plurality of copies.

Figure 7:
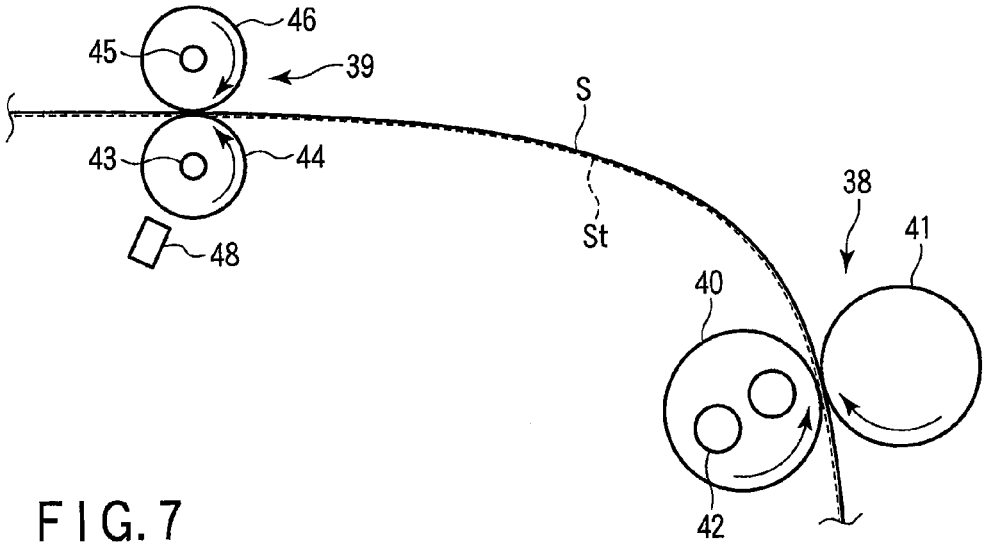
FIG. 7 is an exemplary side view showing the configurations of a heating and fixing device and conveying rollers according to a second embodiment.
Figure 8:
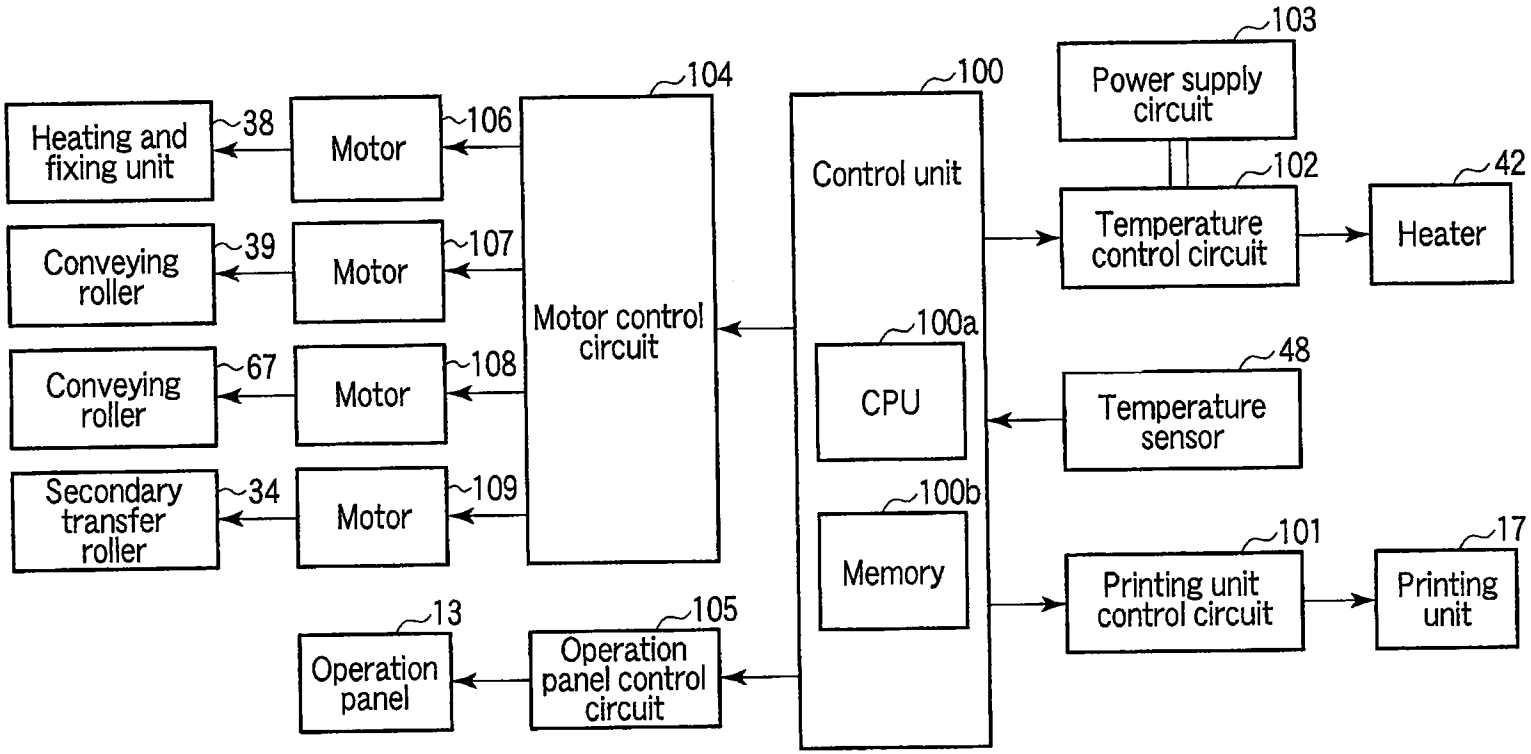
FIG. 8 is an exemplary block diagram showing a control system of an image forming apparatus according to the second embodiment.

A second embodiment will be described. FIG. 7 is a side view showing the configurations of the heating and fixing device 38 and the conveying rollers 39. FIG. 8 is a block diagram showing a control system of the image forming apparatus 1. In the second embodiment, a temperature sensor 48 is provided at a position close to the rubber roller 44. The temperature sensor 48 detects the surface temperature of the rubber roller 44. The temperature sensor 48 outputs the detection result to the control unit 100. The temperature sensor 48 may be a non-contact sensor or a contact sensor such as a thermistor, and the kind thereof is not limited.

In the second embodiment, when the gloss mode is selected through the operation panel 13, the control unit 100 performs a plurality of circulation operations of the sheet S before the start of a printing operation. The control unit 100 determines whether or not the surface temperature of the rubber roller 44 is equal to the temperature T2 on the basis of the detection result of the temperature sensor 48 during the plurality of circulation operations of the sheet S. In addition, that the surface temperature of the rubber roller 44 is equal to the temperature T2 means that the surface temperature of the rubber roller 44 is in an allowable range including the temperature T2.

The control unit 100 repeats the circulation operation of the sheet S until it is determined that the surface temperature of the rubber roller 44 of the conveying rollers 39 becomes equal to the temperature T2. That is, the control unit 100 adjusts the number of circulations on the basis of the detection result of the sensor 48. When the control unit 100 determines that the surface temperature of the rubber roller 44 is equal to the temperature T2, the control unit 100 controls the sheet S to be discharged to the paper discharge unit 50 from the conveying rollers 39. Thereafter, the control unit 100 starts the printing operation as in the first embodiment.

In addition, when a continuous printing operation of a plurality of copies is input through the operation panel 13, the control unit 100 may determine whether or not the surface temperature of the rubber roller 44 is a defined temperature T3 lower than the temperature T2 during the continuous printing operation. The defined temperature T3 is, for example, a temperature at which the rubber roller 44 takes away heat from the toner St, and is not limited as long as the temperature is a temperature at which stripe-like unevenness in gloss caused by the rubber roller 44 becomes noticeable. When the control unit 100 determines that the surface temperature of the rubber roller 44 is reduced to the temperature T3, the control unit 100 may suspend the printing operation and control the circulation operation of the sheet S to be repeated until the surface temperature of the rubber roller 44 is returned to the temperature T2. In this case, it is possible to prevent the temperature of the conveying rollers 39 from reducing during the continuous printing operation of the plurality of copies.

According to the second embodiment, since the surface temperature of the rubber roller 44 becomes close to substantially the same temperature as the temperature T2, in regard to the sheet S onto which the toner image is secondarily transferred, strip-like unevenness in gloss caused by the contact with the rubber roller 44 can be suppressed.

The first and second embodiments may be modified as follows. For an example, the control unit 100 may control the sheet S used for the circulation operation so as not to be discharged to the paper discharge unit 50 from the conveying rollers 39 and to be conveyed to the upstream side of the secondary transfer roller 34 via the reverse conveyance path 68. In this case, the control unit 100 controls the printing unit 17 to secondarily transfer the toner image onto the sheet S passing between the driving roller 31 and the secondary transfer roller 34. Therefore, waste sheets S can be reduced. For another example, the control unit 100 may control the circulation operation to be performed using a plurality of sheets S. In this case, the temperature of the conveying rollers 39 is rapidly increased to the temperature T2 as compared with the case where the circulation operation is performed using a single sheet S.

For another example, the control unit 100 may control the secondary transfer roller 34 to be moved to a position separated from the intermediate transfer belt 21 during the plurality of circulation operations of the sheet S. Although the residual toner on the intermediate transfer belt 21 is cleaned by the belt cleaner 35, there may be a case where the cleaning is not perfect. Therefore, when the secondary transfer roller 34 is at the position separated from the intermediate transfer belt 21, a concern that the residual toner on the intermediate transfer belt 21 is adhered to the sheet S passing between the driving roller 31 and the secondary transfer roller 34 is eliminated.

For another example, when a plurality of conveying rollers is provided between the heating and fixing device 38 and the paper discharge unit 50 and on the downstream side of the conveying rollers 39, the control unit 100 may perform the plurality of circulation operations of the sheet S at least on the conveying roller closest to the heating and fixing device 38. This is because the sheet S immediately after passing through the heating and fixing device 38 is at a high temperature and thus the conveying roller closest to the heating and fixing device 38 is more likely to take away heat from the sheet S passing through the conveying rollers 39.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a printing unit configured to form an image by transferring toner onto a sheet;

a fixing device configured to heat and fix the toner onto the sheet, the fixing device being disposed on a downstream side of the printing unit;

a conveying roller configured to convey the sheet from the fixing device, the conveying roller being disposed on a downstream side of the fixing device; and a control unit configured to control the sheet heated by the fixing device to pass through the conveying roller a plurality of times before the image is formed on the sheet by the printing unit.

2. The apparatus of claim 1, wherein the control unit is configured to adjust the number of passes of the sheet heated by the fixing device through the conveying roller so that a temperature of the conveying roller becomes close to a temperature of the sheet which reaches the conveying roller.

3. The apparatus of claim 1, further comprising a circulation unit configured to circulate the sheet conveyed by the conveying roller to an upstream side of the fixing device.

4. The apparatus of claim 1, wherein the control unit is configured to control a plurality of sheets heated by the fixing device to pass through the conveying roller a plurality of times.

5. The apparatus of claim 1, further comprising a sensor configured to detect a temperature of the conveying roller.

6. The apparatus of claim 5, wherein the control unit is configured to adjust the number of passes of the sheet heated by the fixing device through the conveying roller based on a detection result of the sensor.

7. The apparatus of claim 1, further comprising a plurality of conveying rollers on the downstream side of the fixing device, wherein the control unit is configured to control the sheet heated by the fixing device to circulate a plurality of times through at least the conveying roller which is closest to the fixing device.

8. The apparatus of claim 1, wherein the control unit is configured to adjust a temperature of the conveying roller to be close to a temperature obtained by subtracting an amount of decrease in a temperature of the sheet caused while the sheet is moved from the fixing device to the conveying roller, from a temperature of the sheet immediately after passing through the fixing device.

9. The apparatus of claim 1, wherein the control unit is configured to control the sheet which passes through the conveying roller the plurality of times to be discharged from the conveying roller.

10. The apparatus of claim 1, wherein the control unit is configured to control the printing unit to form the image on the sheet which passes through the conveying roller the plurality of times.

11. An image forming method used in an image forming apparatus including a printing unit configured to form an image by transferring toner onto a sheet, a fixing device configured to heat and fix the toner onto the sheet, the fixing device being disposed on a downstream side of the printing unit, and a conveying roller configured to convey the sheet from the fixing device, the conveying roller being disposed on a downstream side of the fixing device, the method comprising:

before the printing unit forms the image on the sheet, passing the sheet heated by the fixing device through the conveying roller a plurality of times.

12. The method of claim 11, further comprising adjusting the number of passes of the sheet heated by the fixing device through the conveying roller so that a temperature of the conveying roller becomes close to a temperature of the sheet which passes through the conveying roller.

13. The method of claim 11, further comprising circulating the sheet conveyed by the conveying roller to an upstream side of the fixing device.

14. The method of claim 11, further comprising passing a plurality of sheets heated by the fixing device through the conveying roller a plurality of times.

15. The method of claim 11, further comprising detecting a temperature of the conveying roller using a sensor.

16. The method of claim 15, further comprising adjusting the number of passes of the sheet heated by the fixing device through the conveying roller based on a detection result of the sensor.

17. The method of claim 11, wherein the image forming apparatus includes a plurality of conveying rollers on the downstream side of the fixing device, the method further comprising circulating the sheet heated by the fixing device a plurality of times through at least the conveying roller which is closest to the fixing device.

18. The method of claim 11, further comprising adjusting a temperature of the conveying roller to be close to a temperature obtained by subtracting an amount of decrease in a temperature of the sheet caused while the sheet is moved from the fixing device to the conveying roller, from a temperature of the sheet immediately after passing through the fixing device.

19. The method of claim 11, further comprising discharging the sheet which passes through the conveying roller the plurality of times from the conveying roller.

20. The method of claim 11, further comprising forming the image on the sheet which passes through the conveying roller the plurality of times by the printing unit.

* * * * *